US005092306A

United States Patent [19]

Bokelman et al.

[11] Patent Number: 5,092,306

[45] Date of Patent: Mar. 3, 1992

[54] MAGNESITE COMPOSITION FILLER FOR SMOKING ARTICLE WRAPPER

[75] Inventors: Gordon H. Bokelman, Chesterfield; Jay A. Fournier, Richmond; Andrew G. Kallianos; John B. Paine, III, both of Midlothian; Kenneth F. Podraza; Jeffrey I. Seeman, both of Richmond, all of Va.

[73] Assignee: Philip Morris Incorporated, New York, N.Y.

[21] Appl. No.: 600,423

[22] Filed: Oct. 19, 1990

[51] Int. Cl.[5] ..... A24D 1/02
[52] U.S. Cl. ..... 131/365; 162/139
[58] Field of Search ..... 131/365; 162/139

[56] References Cited

U.S. PATENT DOCUMENTS

| | | | |
|---|---|---|---|
| 2,673,565 | 3/1954 | Schur | 131/365 |
| 4,231,377 | 11/1980 | Cline et al. | 131/365 |
| 4,420,002 | 12/1983 | Cline | 131/365 |
| 4,433,697 | 2/1984 | Cline et al. | 131/365 |
| 4,450,847 | 5/1984 | Owens | 131/365 |
| 4,805,644 | 2/1989 | Hampl et al. | 131/365 |
| 4,881,557 | 11/1989 | Martin | 131/365 |
| 4,915,118 | 4/1990 | Kaufman et al. | 131/365 |

*Primary Examiner*—V. Millin
*Attorney, Agent, or Firm*—Michael P. Morris

[57] ABSTRACT

An improved smoking article wrapper which significantly reduces sidestream smike using magnesium carbonate in the form of magnesite as a filler. Smoking articles which employ the wrappers exhibit a significant reduction in sidestream smoke without adverse effect on subjective characteristics.

49 Claims, No Drawings

MAGNESITE COMPOSITION FILLER FOR SMOKING ARTICLE WRAPPER

BACKGROUND OF THE INVENTION

The invention relates to a smoking article wrapper, and in particular, cigarette paper which uses magnesite as a filler composition. Smoking articles which employ the wrappers of the invention exhibit significantly reduced sidestream smoke.

Sidestream smoke is the smoke given off by the burning end of a cigarette or cigarette-like smoking article between puffs. Such smoke may be objectionable to those near the smoker who are not smoking or do not smoke.

Various attempts have been made to reduce sidestream smoke through the use of various cigarette paper fillers such as magnesium hydroxide ($Mg(OH)_2$). See, e.g. U.S. Pat. Nos. 4,881,557, 4,450,847 and 4,433,697. While magnesium hydroxide significantly reduces sidestream smoke, it presents a cigarette with a poor taste and other negative attributes. To overcome this problem, the use of flavoring agents in the paper has been suggested. This suggestion, however, has met with little success.

It is an object of this invention to provide a smoking article wrapper which reduces sidestream smoke without adversely affecting the taste of the cigarette.

SUMMARY OF THE INVENTION

The wrappers of the invention comprise ordinary cigarette paper having magnesite as a filler. The magnesite filler loading is between 15 to 45% by weight of the paper with a preferred loading of between 25 and 35% by weight. Sizing agents such as alkali metal salts of carboxylic acids may be added at an amount equal to between 2 and 15% by weight with the preferred salts being potassium citrate and potassium succinate.

The papers of the invention have a basis weight of between 25 and 70 grams per square meter and have a porosity of between about 2 and 15 cubic centimeters per minute per square centimeter as measured by the CORESTA method. The preferred basis weight is about 45 to 65 grams per square meter and the preferred porosity range is between 5 and 7 cubic centimeters per minute per square centimeter of paper (CORESTA Units).

DETAILED DESCRIPTION OF THE INVENTION

To prepare the wrappers of the invention, conventional cigarette paper manufacturing procedures are used with the substitution of magnesite ($MgCO_3$) for the conventional calcium carbonate filler. Magnesite is distinguished from the magnesium carbonate generally used and taught by others in the art. Magnesium carbonate which is generally available is actually equivalent to the mineral hydromagnesite having the general chemical formula $Mg_5(CO_3)_4(OH)_2.4H_2O$. This is chemically, physically, and structurally different from magnesite ($MgCO_3$) which is the filler used in this invention. Magnesite is readily distinguished from hydromagnesite by x-ray diffraction analysis, thermogravimetric analysis or elemental analysis. Subjective testing of cigarettes made with hydromagnesite or magnesite has shown that magnesite is preferred.

Magnesite can be obtained either from natural sources, such as mineral deposits, or can be made synthetically from such, as for example, hydromagnesite, magnesium hydroxide, or magnesium oxide.

It should be appreciated that magnesite is a very specific mineral form of magnesium carbonate and that synthetic magnesite is not a common item of commerce. Although synthetic magnesite can be prepared by hydrothermal procedures, examples of which are disclosed herein, it should further be appreciated that, in addition to hydromagnesite mentioned above, there are other forms of magnesium carbonate. However, the only one which compositionally corresponds to the exact molecular formula of $MgCO_3$ is magnesite. As such, it is a distinct and unique form of magnesium carbonate. Unless specifically described as magnesite, all other forms of magnesium carbonates (e.g. artinite ($Mg_2(CO_3)(OH)_2.3H_2O$), dypingite ($Mg_5(CO_3)_4(OH)_2.5H_2O$), giorgiosite ($Mg_5(CO_3)_4(OH)_2.5H_2O$), hydromagnesite ($Mg_5(CO_3)_4(OH)_2.4H_2O$), lansfordite ($MgCO_3.5H_2O$) and nesquehonite ($MgCO_3.3H_2O$)) are not magnesite and do not correspond chemically to the formula $MgCO_3$. Aside from its unique chemical composition, magnesite can be distinguished from other forms of magnesium carbonates by its thermal stability. Magnesite is the most thermally stable form of all the magnesium carbonates, decomposing thermally only when heated above 500° C. All of the other magnesium carbonates decompose at less than 500° C.

In the case of naturally occurring magnesite, it is preferable to use magnesite which is free from substances which might present toxicological problems. It is also preferable to use magnesite relatively free of other minerals such as dolomite or calcite. The presence of small amounts of these minerals, however, does not adversely affect the sidestream smoke reduction achieved by using magnesite. One source of natural magnesite is The Baymag Company of British Columbia, Canada.

For synthetic magnesite derived from other magnesium compounds, the product of such chemical reactions should be at least about 95% magnesite. Complete conversion of the magnesium precursor is not essential to the practice of the invention.

In the practice of the invention, magnesite may be blended with other filler compounds without significant effect on the sidestream smoke reduction achieved by using magnesite. In the case of such blends, at least 50% by weight of the resulting filler should be magnesite. The balance of the filler may comprise one or more of the following: inorganic oxide, inorganic hydroxide or inorganic carbonate. These compounds include magnesium oxide, magnesium hydroxide, calcium carbonate and titanium oxide as well as other fillers known in the art.

Included within the scope of this invention is magnesite having a superficial surface area of less than twenty square meters per gram as measured by the BET method.

The paper wrappers of this invention may be made from flax, vegetable or other plant fibers. Other than the use of magnesite as a filler, standard cigarette wrapper manufacturing procedures are used to create the wrappers of the invention. In addition, the paper wrappers of this invention may be a conventional one layer construction, a multiwrapped construction or a multilayer single wrap construction.

In the preferred embodiment, sizing agents, such as alkali metal salts of carboxylic acids, are used to adjust or control the static burn rate of the resulting smoking article. Particularly good sizing agents include sodium fumarate and potassium salts, namely potassium citrate and potassium succinate. Of these, potassium citrate and potassium succinate are preferred.

As used herein the term tobacco includes not only cut tobacco leaf filler usually found in cigarettes, but also includes expanded tobacco, extruded tobacco, reconstituted tobacco, tobacco stems, tobacco substitutes and synthetic tobacco.

EXAMPLES

The following examples illustrate the practice and beneficial results of this invention.

To measure the amount of sidestream smoke generated, burning cigarettes are allowed to free burn while the sidestream smoke travels through a cell through which a light is passed. A photocell detects the transmitted light intensity during the burning of 30 millimeters of the tobacco rod. The measured light intensity over the course of burning is determined and compared to the light intensity when no smoke is present in the cell. The difference between the two values is reported as the extinction coefficient (EC).

The tables in the following examples show the percent reduction in visible sidestream smoke as calculated from various extinction coefficients of the test samples versus a control. The control is either a typical 85 or 100 millimeter commercial cigarette having a 25 gram per square meter paper wrapper with a porosity of about 30 CORESTA units and a citrate sizing agent. Test cigarettes were made by hand at comparable packing densities using the same tobacco filler as the control. All test samples were of standard circumference (about 25 millimeters) and 85 or 100 millimeters in length including a 27 millimeter cellulose acetate filter.

Static Burn Time (SBT) is the amount of time it takes a cigarette to burn 40 millimeters under static conditions. In other words, it is the rate at which a cigarette smolders in the absence of drafts or puffing action. In the tables below, SBT is expressed in terms of minutes, basis weight is expressed in grams per square meter, porosity is in CORESTA units, and sizing is in weight percent.

EXAMPLE 1

Magnesite was prepared hydrothermally from hydromagnesite using the following procedure:

Basic magnesium carbonate (hydromagnesite) was slurried in water and added to a pressure reactor. An over-pressure of carbon dioxide of up to 830 psig (as measured at room temperature) was applied and the mixture was heated to 200° C. The reaction pressures can, of course, vary, depending upon the amount of basic magnesium carbonate present and the free volume in the reactor. The pressure rose initially due to the heating and then fell as the reaction progressed. After two days, the mixture was cooled and the excess carbon dioxide vented. The solids were then removed, filtered, washed, and air dried. Analysis of the solids revealed that the basic magnesium carbonate was converted to magnesite having a surface area of 7.0 $m^2/g$.

The generated magnesite was then used as a filler to make handsheets with basis weights of 45, 55 and 65 grams per square meter. In each case, the filler loading was 30% by weight of magnesite. Potassium citrate was added as a sizing agent at the levels indicated below. The porosity of the sheets ranged from 4.5 to 6.7 cubic centimeters per minute per square centimeter as measured by the CORESTA method.

The papers were then used to prepare cigarettes which in turn were evaluated for SBT and EC as well as subjective evaluations for taste and ash appearance. The results of the SBT and EC evaluations are found in Table 1.

TABLE 1

| Sample | Basis Wt | Coresta Porosity | Sizing | SBT | EC | EC × SBT* | % EC Reduct** |
|---|---|---|---|---|---|---|---|
| Control | | | | 8.1 | 0.73 | 5.91 | — |
| 1 | 45 | 6.7 | 6.8 | 11.2 | 0.28 | 3.14 | 62 |
| 2 | 45 | 6.7 | 8.0 | 9.9 | 0.28 | 2.77 | 62 |
| 3 | 45 | 6.7 | 8.7 | 10.6 | 0.34 | 3.60 | 53 |
| 4 | 55 | 5.9 | 6.6 | 11.2 | 0.18 | 2.02 | 75 |
| 5 | 55 | 5.9 | 8.1 | 11.3 | 0.25 | 2.82 | 66 |
| 6 | 65 | 4.5 | 6.6 | 11.1 | 0.20 | 2.22 | 73 |
| 7 | 65 | 4.5 | 7.9 | 12.2 | 0.16 | 1.95 | 78 |

*Product of the Static Burn Time and the EC.
**Percent Reduction in E.C. compared to the Control.
Evaluation of samples 1-7 revealed positive subjectives.

EXAMPLE 2

The magnesite prepared above was then used to prepare a series of cigarettes similar to those in Examples 1-7 with the exception that potassium succinate was used as the sizing agent/burn enhancer. The cigarettes and paper were evaluated as above and the results are reported in Table 2.

TABLE 2

| Sample | Basis Wt | Coresta Porosity | Sizing | SBT | EC | EC × SBT* | % EC Reduct** |
|---|---|---|---|---|---|---|---|
| Control | | | | 8.2 | 0.93 | 7.63 | — |
| 8 | 45.4 | 3.5 | 8.4 | 10.2 | 0.39 | 3.98 | 58 |
| 9 | 45.0 | 8.7 | 7.0 | 12.4 | 0.26 | 3.22 | 72 |
| 10 | 45.0 | 8.7 | 6.6 | 10.9 | 0.34 | 3.71 | 63 |
| 11 | 55.0 | 6.8 | 5.7 | 11.1 | 0.34 | 3.77 | 63 |

*Product of the Static Burn Time and the EC.
**Percent reduction in EC compared to the Control.

EXAMPLE 3

A third series of experiments was conducted to examine the effect of sizing agents and levels of sizing agents. The sample papers and cigarettes were prepared as described above with varying levels of potassium citrate or potassium succinate. The papers and cigarettes were evaluated and the results are set forth in Table 3.

TABLE 3

| Sample | Basis Wt | Coresta Porosity | Sizing | SBT | EC | EC × SBT* | % EC Reduct** |
|---|---|---|---|---|---|---|---|
| Control | | | | 8.2 | 0.87 | 7.13 | |
| Potassium Citrate ($K_3Cit.$) | | | | | | | |
| 12 | 45.5 | 4.7 | 3.8 | 11.0 | 0.42 | 4.62 | 52 |
| 13 | 45.4 | 4.5 | 5.1 | 10.9 | 0.40 | 4.36 | 54 |
| 14 | 45.0 | 4.7 | 7.1 | 10.9 | 0.36 | 3.92 | 59 |
| 15 | 45.5 | 4.0 | 7.9 | 10.6 | 0.37 | 3.92 | 57 |
| 16 | 45.5 | 4.0 | 9.7 | 10.8 | 0.36 | 3.89 | 59 |
| Potassium Succinate ($K_2Succ.$) | | | | | | | |
| 17 | 46.0 | 4.0 | 4.2 | 11.4 | 0.36 | 4.10 | 59 |
| 18 | 46.0 | 3.7 | 5.3 | 10.8 | 0.39 | 4.21 | 55 |
| 19 | 45.5 | 4.0 | 7.6 | 10.8 | 0.37 | 4.00 | 57 |
| 20 | 45.2 | 4.0 | 8.5 | 10.8 | 0.41 | 4.43 | 53 |

TABLE 3-continued

| Sample | Basis Wt | Coresta Porosity | Sizing | SBT | EC | EC × SBT* | % EC Reduct** |
|---|---|---|---|---|---|---|---|
| 21 | 45.5 | 3.6 | 8.9 | 10.8 | 0.37 | 4.00 | 57 |

*Product of the Static Burn Time and the EC.
**Percent reduction as compared to the Control.

As seen from these examples, variation in the amount of either of the sizing agents does not appear to cause significant variation in the reduction of sidestream smoke.

EXAMPLE 4

In the next series, natural magnesite obtained from Baymag was ground to yield particles having a superficial surface area of 10.6 square meters per gram. The natural magnesite was then used to prepare cigarette papers and cigarettes in the manner described above. The magnesite filler loading for Examples 22 through 24 was 30% by weight and for sample 25, the loading was 40% by weight. The cigarettes and papers were then evaluated and the results are set forth in Table 4.

TABLE 4

| Sample | Basis Wt | Coresta Porosity | Sizing | SBT | EC | EC × SBT* | % EC Reduct** |
|---|---|---|---|---|---|---|---|
| Control | | | | 8.5 | 0.87 | 7.40 | |
| 22 | 45 | 4.7 | 9.9 $K_3Cit.$ | 9.2 | 0.36 | 3.31 | 59 |
| 23 | 65 | 5.5 | 7.2 $K_2Succ.$ | 8.6 | 0.45 | 3.87 | 48 |
| 24 | 65 | 5.8 | 7.6 $Na_2$ Fumarate | 10.1 | 0.48 | 4.85 | 45 |
| 25 | 45 | 6.2 | 9.2 $K_3Cit.$ | 8.5 | 0.36 | 3.06 | 59 |

*Product of the Static Burn Time and the EC.
**Percent reduction as compared to the Control.

EXAMPLE 5

A series of cigarettes was prepared from handsheets containing a filler comprising magnesite. The magnesite was prepared by hydrothermally reacting magnesium hydroxide with carbon dioxide in an aqueous slurry at 200° C. for 48 hours. The product was then filtered, washed and air dried. The final product was predominately magnesite with small amounts of magnesium hydroxide present. The residual magnesium hydroxide is believed to be due to the incomplete conversion of the magnesium hydroxide to magnesite, either due to a deficiency in the amount of carbon dioxide taken and/or to reaction time. The papers were sized with potassium succinate. The cigarettes were evaluated as discussed above and the results are recorded in Table 5.

TABLE 5

| Sample | Basis Wt | Coresta Porosity | Sizing | SBT | EC | EC × SBT* | % EC Reduct** |
|---|---|---|---|---|---|---|---|
| Control | | | | 8.3 | 0.82 | 6.81 | |
| 26 | 45.5 | 3.5 | 6.4 | 9.7 | 0.32 | 3.10 | 61 |
| 27 | 45.5 | 2.0 | 11.5 | 10.0 | 0.26 | 2.60 | 68 |

*Product of the Static Burn Time and the EC.
**Percent reduction as compared to the Control.

By analysis the filler used in samples 26 and 27 contained 98.5% magnesite and 1.5% magnesium hydroxide. The cigarettes exhibited excellent sidestream smoke reduction. More importantly, these cigarettes exhibited positive subjectives during evaluation.

EXAMPLE 6

A series of cigarettes was prepared from handsheets containing a filler comprising a mixture of natural magnesite with calcium carbonate. The magnesite had a surface area of 10.6 square meters per gram. The cigarettes both had a filler loading of 30 percent by weight. Sample 28 contained 25% by weight magnesite and 5% by weight Multifex MM calcium carbonate and Sample 29 contained 15% by weight magnesite and 15% by weight Multifex MM calcium carbonate. Potassium succinate was used as the sizing agent for both samples. The cigarettes were evaluated as discussed above and the results are recorded in Table 6.

TABLE 6

| Sample | Basis Wt | Coresta Porosity | Sizing | SBT | EC | EC × SBT* | % EC Reduct** |
|---|---|---|---|---|---|---|---|
| Control | | | | 8.4 | 0.90 | 7.56 | |
| 28 | 45.0 | 5.7 | 11.0 | 10.8 | 0.31 | 3.35 | 66 |
| 29 | 45.4 | 3.3 | 4.77 | 8.8 | 0.5 | 4.40 | 44 |

*Product of the Static Burn Time and the EC.
**Percent reduction as compared to the Control.

EXAMPLE 7

In this series, cigarettes were made from handsheets having a filler loading of 35% by weight. Sample 30 contained strictly natural magnesite, and Sample 31 contained 30% by weight natural magnesite and 5% by weight Multiflex MM calcium carbonate. Sample 32 contained 25% by weight natural magnesite and 10% Multifex MM calcium carbonate. Potassium citrate was used as a sizing agent. The cigarettes were evaluated as discussed above and the results are recorded in Table 7.

TABLE 7

| Sample | Basis Wt | Coresta Porosity | Sizing | SBT | EC | EC × SBT* | % EC Reduct** |
|---|---|---|---|---|---|---|---|
| Control | | | | 8.7 | 0.82 | 7.13 | |
| 30 | 45 | 5.2 | 8.0 | 9.3 | 0.27 | 2.51 | 67 |
| 31 | 45 | 6.0 | 7.8 | 8.7 | 0.28 | 2.44 | 66 |
| 32 | 45 | 5.4 | 8.6 | 8.3 | 0.32 | 2.66 | 61 |

*Product of the Static Burn Time and the EC.
**Percent reduction as compared to the Control.

As seen from Examples 6 and 7, magnesite may be combined with up to about equal amounts of traditional fillers such as calcium carbonate and still provide a cigarette with significantly reduced sidestream smoke. The resulting cigarettes also exhibited positive subjective qualities.

Thus, it is seen from the foregoing examples that a paper wrapper for a cigarette is provided that results in reduced amounts of sidestream smoke. One skilled in the art will appreciate that the present invention can be practiced by other than the desired embodiments which are presented for purposes of illustration and not of limitation, and the present invention is limited by the claims that follow.

What is claimed is:

1. A paper suitable for use as a smoking article wrapper comprising plant fiber and about 15 to 45% magnesite filler.

2. The paper defined in claim 1 having a porosity of between 2 and 15 cubic centimeters per minute per square centimeter by the CORESTA method.

3. The paper defined in claim 1 wherein said magnesite has a surface area of less than about 20 square meters per gram as measured by the BET method.

4. The paper defined in claim 1 having a basis weight of about 25 to 70 grams per square meter.

5. The paper defined in claim 1 having a basis weight of about 45 to 65 grams per square meter.

6. The paper defined in claim 1 further comprising 2–15% by weight of a sizing agent.

7. The paper defined in claim 6 wherein said sizing agent is selected from the group consisting of potassium citrate, potassium succinate, and sodium fumarate.

8. A paper suitable for use as a smoking article wrapper comprising plant fiber, about 15 to 45% by weight magnesite filler, about 2–15% by weight of a sizing agent selected from the group consisting of potassium citrate, potassium succinate, and sodium fumarate, and having a porosity of about 2 to 15 cubic centimeters per minute per square centimeter as determined by the CORESTA method.

9. The paper defined in claim 8 wherein said magnesite has a surface area of about less than 20 square meters per gram.

10. The paper defined in claim 8 or 9 further defined as having a basis weight of about 25 to 70 grams per square meter.

11. A paper suitable for use as a smoking article wrapper comprising plant fibers, 15 to 45% by weight filler, wherein at least 50% of said filler comprises magnesite and the balance of said filler comprises an admixture of one or more of the following: inorganic oxide, inorganic hydroxide or an inorganic carbonate.

12. The paper defined in claim 11 wherein said admixture comprises calcium carbonate.

13. The paper defined in claim 11 wherein said admixture comprises magnesium hydroxide.

14. The paper defined in claim 11 wherein said admixture comprises magnesium oxide.

15. The paper defined in claim 11 wherein said admixture comprises hydromagnesite.

16. The paper defined in claims 11, 12, 13, 14 or 15 further defined as having a basis weight of about 25 to 70 grams per square meter.

17. A paper suitable for use as a smoking article wrapper comprising plant fibers, 15 to 45% by weight filler; said filler comprising at least 50% magnesite and the balance of said filler comprising an admixture of one or more of the following: inorganic oxide, inorganic hydroxide or inorganic carbonate; said paper having a basis weight of between about 25 and 70 grams per square meter.

18. The paper defined in claim 17 further comprising about 2–15% by weight of a sizing agent.

19. The paper defined in claim 17 wherein said sizing agent is selected from the group consisting of potassium citrate, potassium succinate and sodium fumarate.

20. The paper defined in claim 17 having a porosity of between about 2 and 15 cubic centimeters per minute per square centimeter as determined by the CORESTA method.

21. The paper defined in claim 17 wherein said admixture comprises magnesium hydroxide.

22. The paper defined in claim 17 wherein said admixture comprises magnesium oxide.

23. The paper defined in claim 17 wherein said admixture comprises calcium carbonate.

24. The paper defined in claim 17 wherein said admixture comprises hydromagnesite.

25. A smoking article having reduced sidestream smoke comprising a tobacco rod surrounded by a paper wrapper, said wrapper having a magnesite filler loading of about 15 to 45% by weight.

26. The smoking article defined in claim 25 wherein said wrapper further comprises about 2 to 15% by weight sizing agent selected from the group comprising potassium citrate, potassium succinate and sodium fumarate.

27. The smoking article defined in claim 25 wherein said wrapper has a porosity of between 2 and 15 cubic centimeters per minute per square centimeter as determined by the CORESTA method.

28. The smoking article defined in claim 25 further defined in that said smoking article has an Extinction Coefficient of less than about 0.60.

29. The smoking article defined in claim 25, wherein said paper wrapper has a basis weight of between about 25 and 70 grams per square meter.

30. The smoking article defined in claim 25 wherein said smoking article has a static burn time of 7 to 13 minutes.

31. A smoking article comprising a tobacco rod surrounded by a paper wrapper, said paper wrapper comprising plant fiber, about 15–45% by weight magnesite filler and about 2–15% by weight sizing agent.

32. The smoking article defined in claim 31 said paper wrapper further defined as having a porosity of between 2 and 15 cubic centimeters per minute per square centimeter as defined by the CORESTA method.

33. The smoking article defined in claim 31 further defined as having an extinction coefficient of less than 0.60.

34. The smoking article defined in claim 31 further defined as having a filler with a superficial surface area of less than 20 square meters per gram as measured by the BET method.

35. The smoking article of claim 31 wherein said smoking article has a static burn time of about 7 to 13 minutes.

36. A smoking article having reduced side-stream smoke comprising a tobacco rod surrounded by a paper wrapper, said paper wrapper comprising plant fiber and 15% to 45% by weight filler, said filler comprising at least 50% magnesite and a balance of said filler comprising an admixture of one or more of the following: inorganic oxide, inorganic hydroxide or inorganic carbonate.

37. The smoking article defined in claim 36 wherein said admixture comprises magnesium oxide.

38. The smoking article defined in claim 36 wherein said admixture comprises magnesium hydroxide.

39. The smoking article defined in claim 36 wherein said admixture comprises calcium carbonate.

40. The smoking article defined in claim 36 wherein said admixture comprises hydromagnesite.

41. The smoking article defined in claim 36 wherein said magnesite has a surface area of less than about 20 square meters per gram.

42. The smoking article defined in claim 36 wherein said paper wrapper further comprises 2 to 15% by weight of a sizing agent.

43. The smoking article defined in claim 36 wherein said paper wrapper has a basis weight of about 25 to 70 grams per square meter.

44. The smoking article defined in claim 36 wherein said paper wrapper has a porosity of between about 2 and 15 cubic centimeters per minute per square centimeter as determined by the CORESTA method.

45. The smoking article defined in claim 36 further defined as having an extinction coefficient of less than about 0.60.

46. The smoking article defined in claim 36 further defined as having a static burn time of about 7 to 13 minutes.

47. A smoking article having reduced sidestream smoke comprising a tobacco rod, and a paper wrapper circumscribing said rod; said paper wrapper comprising plant fiber, about 15 to 45% by weight of a filler; said filler comprising a blend of at least 50% magnesite and one or more other filler compounds selected from the group comprising magnesium oxide, magnesium hydroxide, calcium carbonate and hydromagnesite.

48. The smoking article defined in claim 47 further defined as having an extinction coefficient of less than 0.60.

49. The smoking article defined in claim 47 further defined as having a static burn time of about 7 to 13 minutes.

* * * * *